US009970728B1

(12) United States Patent
Huang

(10) Patent No.: US 9,970,728 B1
(45) Date of Patent: May 15, 2018

(54) EJECTION PORT COVER

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 0 days. days.

(21) Appl. No.: 14/965,931

(22) Filed: Dec. 11, 2015

(51) Int. Cl.
*F41A 35/02* (2006.01)

(52) U.S. Cl.
CPC ..... *F41A 35/02* (2013.01)

(58) Field of Classification Search
CPC ..... F41A 35/02; F41C 27/00
USPC ..... 42/96, 75.01
See application file for complete search history.

(56) References Cited

U.S. PATENT DOCUMENTS 2,599,689 A * 6/1952 Brelsford ..... F41A 35/02 359/511
3,156,991 A * 11/1964 Adams ..... F41A 9/60 42/98
3,618,458 A * 11/1971 Pruonto et al. ..... F41A 9/60 42/98
4,028,834 A * 6/1977 Dobson ..... F41A 9/60 42/98
4,204,353 A * 5/1980 Isola ..... F41A 9/60 42/98
4,468,875 A * 9/1984 Harrison ..... F41A 9/76 42/50
4,594,803 A * 6/1986 Muncy ..... F41A 9/60 42/98
4,903,426 A * 2/1990 Bammate ..... F41A 9/60 42/98
D427,273 S * 6/2000 Plonka ..... D22/100
9,612,075 B1 * 4/2017 Stephens, IV ..... F41A 35/02
2005/0016051 A1 * 1/2005 Fischbach ..... F41A 15/00 42/96
2007/0033851 A1 * 2/2007 Hochstrate ..... F41A 5/18 42/75.01
2007/0261284 A1 * 11/2007 Keng ..... F41C 23/04 42/73
2008/0099004 A1 * 5/2008 Gerardo ..... A63B 69/409 124/73

* cited by examiner

*Primary Examiner* — John Cooper
(74) *Attorney, Agent, or Firm* — Shaddock Law Group, PC

(57) ABSTRACT

A windowed ejection port cover having an ejection port cover body; a window aperture formed through the body; a window element, wherein the window element is formed so as to be at least partially received within the window aperture; and a window coupling element utilized to attach or couple at least a portion of the window element within at least a portion of the window aperture.

2 Claims, 14 Drawing Sheets

EJECTION PORT COVER

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an improved ejection port cover for a firearm.

2. Description of Related Art

Various firearms include an ejection port, which provides an aperture through which spent brass casings or shells may exit the upper receiver after firing.

Certain firearms also include an ejection port cover (sometimes referred to as a dust cover) that selectively covers the ejection port to reduce the opportunity for contaminants, such as sand, dirt, or other debris, to enter the firearm. By way of example, FIGS. 1-4 illustrate an exemplary upper receiver 5 of an AR-15 or M-4 style firearm. As illustrated, the upper receiver 5 includes an ejection port cover 10, having a body 12 and then attached or coupled plunger assembly 15. The ejection port cover 10 is pivotably attached to the upper receiver 5, via interaction of an ejection port cover hinge pin 18 and a pivot aperture 13.

The ejection port cover 10 is typically maintained in a closed position via interaction between the plunger assembly 15 and a recess or feature of the side wall of the ejection port. Generally, the ejection port cover 10 is spring biased to an open position and, if in the closed position, is forced to an open position by interaction between the plunger assembly 15 and the bolt carrier of the firearm.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the typical body 12 of the ejection port cover 10 is formed of a solid, metal material. Thus, when in a closed position, the typical ejection port cover 10 does not allow a user to look into the ejection port to view the interior of the upper receiver 5 and/or the bolt or bolt carrier group.

The disadvantages and shortcomings of the prior art are overcome by the features and elements of the windowed ejection port cover of the present disclosure. The advantages of the present disclosure are preferably attained by providing, in an exemplary, nonlimiting embodiment, a windowed ejection port cover, comprising an apertured ejection port cover, comprising an ejection port cover body; a first window aperture formed through the body; a second window aperture formed through the body; a first window element, wherein the first window element is formed so as to be at least partially received within the first window aperture; a second window element, wherein the second window element is formed so as to be at least partially received within the second window aperture; a first window coupling element utilized to attach or couple at least a portion of the first window element within at least a portion of the first window aperture; and a second window coupling element utilized to attach or couple at least a portion of the second window element within at least a portion of the second window aperture.

In still other exemplary, nonlimiting embodiments, a windowed ejection port cover is provided that comprises an apertured ejection port cover, comprising an ejection port cover body; a window aperture formed through the body; a window element, wherein the window element is formed so as to be at least partially received within the window aperture; and a window coupling element utilized to attach or couple at least a portion of the window element within at least a portion of the window aperture.

In still other exemplary, nonlimiting embodiments, a windowed ejection port cover is provided that comprises an apertured ejection port cover, comprising an ejection port cover body; at least one window aperture formed through the body; and at least one window element, wherein the window element is at least partially received within the window aperture.

In certain exemplary, nonlimiting embodiments, the window element or elements are optionally formed of a transparent, semitransparent, translucent, clear, colored, or semi-opaque material. The window element or elements may optionally be formed of glass, toughened glass, sappire glass, tempered glass, safety glass, an acrylic, Poly(methyl methacrylate), a Polycarbonate, a thermoplastic, a glass-hardened polymer, a polymeric composite, or a high-strength or shatter-resistant glass or plastic.

Accordingly, the presently disclosed systems, methods, and/or apparatuses provide a windowed ejection port cover that may optionally include one or more transparent, semi-transparent, translucent, clear, colored, or semi-opaque portions.

The presently disclosed systems, methods, and/or apparatuses separately provide a windowed ejection port cover that may optionally allow a user to view at least a portion of the interior of a firearm, through an ejection port, when the windowed ejection port cover is in a closed position.

The presently disclosed systems, methods, and/or apparatuses separately provide a windowed ejection port cover that may optionally include a magnifying glass or magnifying glass portion that provides a user with a magnified view of at least a portion of the interior of a firearm, when the windowed ejection port cover is in a closed position.

The presently disclosed systems, methods, and/or apparatuses separately provide a windowed ejection port cover that may optionally include an illuminating portion or illuminating element that provides illumination of at least a portion of the interior of a firearm, when the windowed ejection port cover is in a closed position.

The presently disclosed systems, methods, and/or apparatuses separately provide a windowed ejection port cover that can be utilized in conjunction with a standard upper receiver and/or bolt carrier.

The presently disclosed systems, methods, and/or apparatuses separately provide a windowed ejection port cover that can be easily assembled and/or retrofitted by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
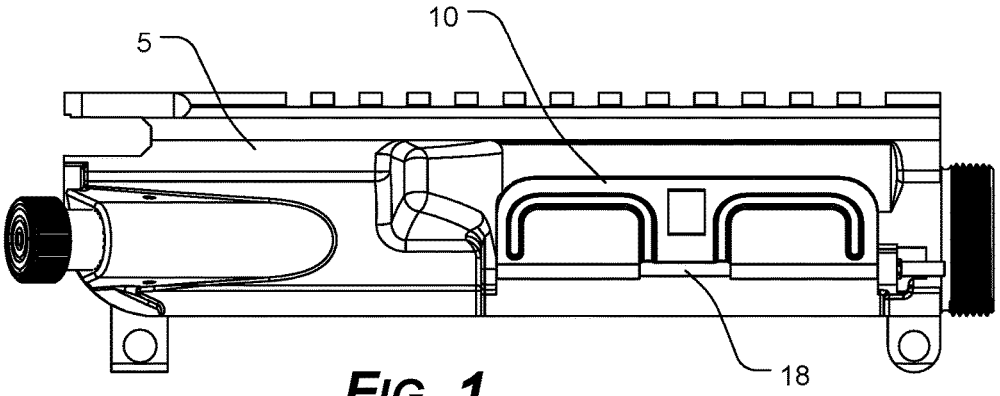
FIG. 1 PRIOR ART
FIG. 1 illustrates a right side view of a standard, AR-15 or M4 style upper receiver, having a known ejection port cover, wherein the ejection port cover is in a closed position.
Figure 2:
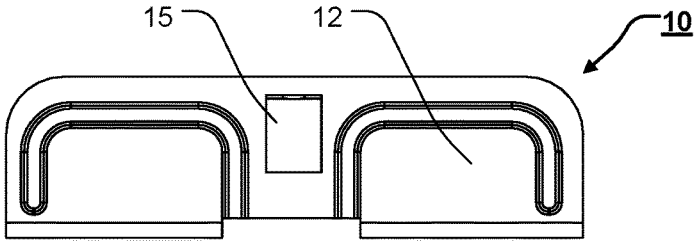
FIG. 2 PRIOR ART
FIG. 2 illustrates a right side view of a standard ejection port cover.
Figure 4:
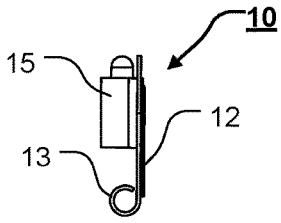
FIG. 4 PRIOR ART
FIG. 4 illustrates a rear view of a standard ejection port cover.
Figure 3:
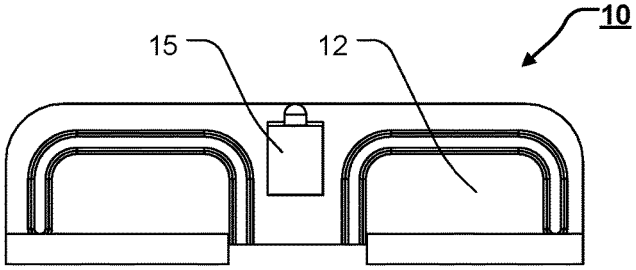
FIG. 3 PRIOR ART
FIG. 3 illustrates a left side view of a standard ejection port cover.
Figure 5:
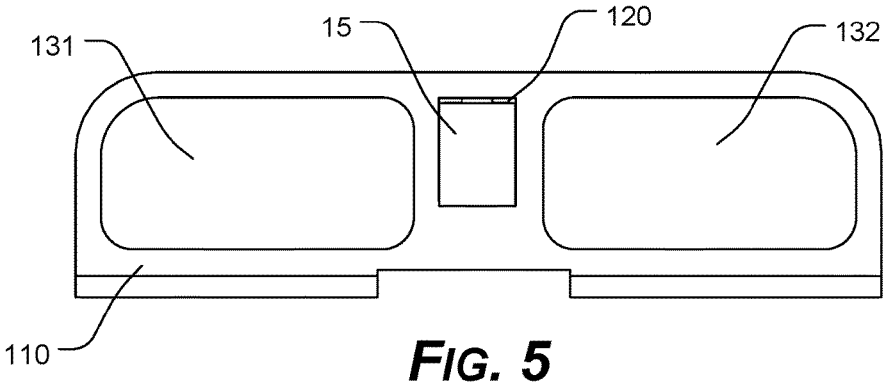
FIG. 5 illustrates a right side view of an exemplary embodiment of an ejection port cover body, having an attached or coupled plunger assembly, according to the presently disclosed systems, methods, and/or apparatuses.
Figure 6:
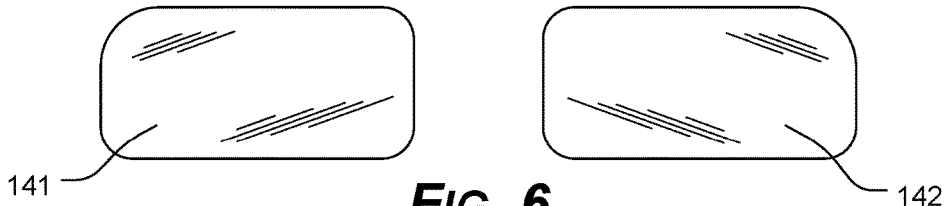
FIG. 6 illustrates a right side view of certain exemplary embodiments of windowed ejection port cover windows, according to the presently disclosed systems, methods, and/or apparatuses.
Figure 7:
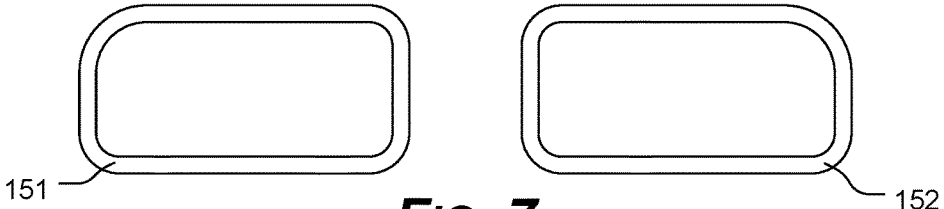
FIG. 7 illustrates a right side view of certain exemplary embodiments of windowed ejection port cover gaskets, according to the presently disclosed systems, methods, and/or apparatuses.
Figure 8:
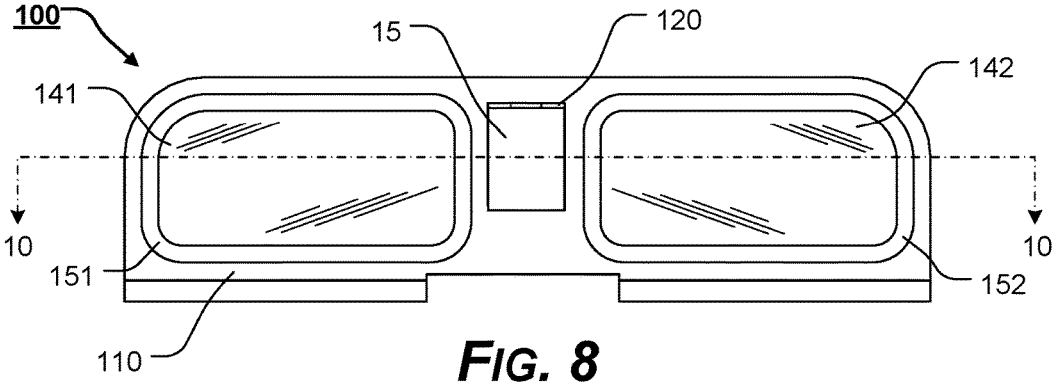
FIG. 8 illustrates a right side view of an exemplary embodiment of a windowed ejection port cover, having an attached or coupled plunger assembly, according to the presently disclosed systems, methods, and/or apparatuses.
Figure 9:
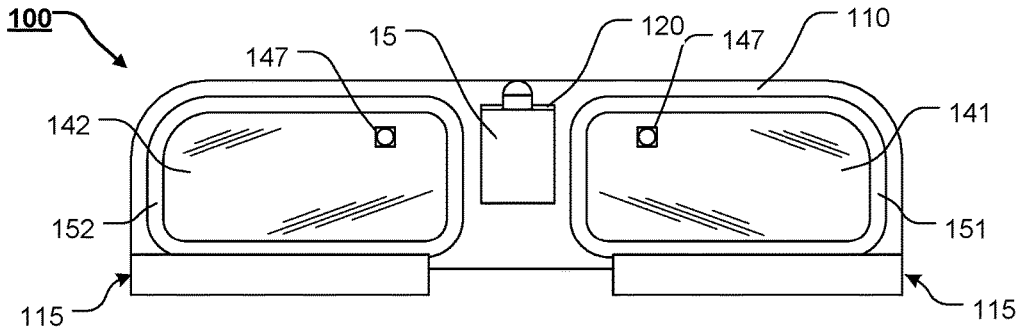
FIG. 9 illustrates a left side view of an exemplary embodiment of a windowed ejection port cover, having an attached or coupled plunger assembly, according to the presently disclosed systems, methods, and/or apparatuses.

For simplicity and clarification, the design factors and operating principles of the windowed ejection port cover according to the presently disclosed systems, methods, and/or apparatuses are explained with reference to various exemplary embodiments of a windowed ejection port cover according to the presently disclosed systems, methods, and/or apparatuses. The basic explanation of the design factors and operating principles of the windowed ejection port cover is applicable for the understanding, design, and operation of the windowed ejection port cover of the presently disclosed systems, methods, and/or apparatuses. It should be appreciated that the windowed ejection port cover can be adapted to many applications where a windowed ejection port cover can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "apertured ejection port cover", "apertured", "window", and "firearm" are used for basic explanation and understanding of the operation of the presently disclosed systems, methods, and/or apparatuses. Therefore, the terms "apertured ejection port cover", "apertured", "window", and "firearm" are not to be construed as limiting the systems, methods, and/or apparatuses of the present disclosure. Thus, for example, the term "firearm" is to be understood to broadly include any upper, lower, or combined receiver for a firearm or other similar handheld or shoulder mounted device or tool.

For simplicity and clarification, the windowed ejection port cover of the present disclosure will be described as being used in conjunction with a firearm, such as an AR-15 or M4 style rifle or carbine. However, it should be appreciated that these are merely exemplary embodiments of the windowed ejection port cover and are not to be construed as limiting the presently disclosed systems, methods, and/or apparatuses. Thus, the windowed ejection port cover of the present disclosure may be utilized in conjunction with any firearm or rifle, such as, for example, an AR-10 style rifle, rifle, replica rifle, or any other tool, device, or object.

Turning now to the drawing FIGS., as discussed above, FIG. 1-4 illustrate various components of a known ejection port cover 10, while FIGS. 5-30 illustrate certain elements and/or aspects of certain exemplary, nonlimiting embodiments of the windowed ejection port cover, according to the presently disclosed systems, methods, and/or apparatuses. In an illustrative, non-limiting embodiment of the present disclosure, as illustrated in FIGS. 5-11, the windowed ejection port cover 100 comprises at least some of an apertured ejection port cover body 110 having a pivot aperture 115 and a plunger assembly aperture 120.

In various exemplary, nonlimiting embodiments, the apertured ejection port cover body 110 has an overall size and shape that allows it to interact with a desired firearm, such as, for example, an upper receiver 5. As illustrated, the pivot aperture 115 is formed of two curved extension portions of the body 110. It should be appreciated that the pivot aperture 115 is formed so as to interact with a known ejection port cover hinge pin 18, so as to be pivotably attached to, for example, an upper receiver 5, via interaction of an ejection port cover hinge pin 18 and the pivot aperture 115.

The plunger assembly aperture 120 is formed so as to allow a plunger assembly 15 to interact with the plunger assembly aperture 120, so as to be attached or coupled to the body 110. It should be appreciated that the pivot aperture 115 and the plunger assembly 15 allow the windowed ejection port cover 100 to be pivotably attached to a firearm and pivot between an open position and a closed position, in a manner similar to a known ejection port cover 10.

In various exemplary embodiments, the body 110 is substantially rigid and is formed of sheet metal, such as steel. Alternate materials of construction of the body 110 may include one or more of the following: aluminum, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the body 110 is a design choice based on the desired appearance and/or functionality of the body 110.

As illustrated in FIGS. 5-11, two or more window apertures are formed through the body 110. As illustrated, the body 110 includes two window apertures, a first window aperture 131 and a second window aperture 132, each having a substantially rectangular overall shape. However, it should be appreciated that the number and overall size, shape, and appearance of window apertures formed through the body 110 is a design choice, based upon the desired number, size, and location of resulting transparent, semitransparent, translucent, clear, colored, or semi-opaque portions of the apertured ejection port cover 110. Thus, it should be understood that the window apertures formed through the body 110 may have an overall round, oval, triangular, square, rectangular, or other defined or unique shape.

It should also be understood that while the windowed ejection port cover 100 is illustrated and described as including two window apertures, the aperture ejection port cover 100 may only include a single window aperture. If only a single window aperture is included, only a single window element is necessary for the windowed ejection port cover 100.

In various exemplary, nonlimiting embodiments, one or more window elements, such as, for example, the first window element 141 and the second window element 142 are included. Each window element is formed such that a window element may be at least partially received within each window aperture. Each window element is formed of a material that provides a see-through or at least partially see-through window in the aperture ejection port cover 100.

For example, in various exemplary, nonlimiting embodiments, the first window element 141 and the second window element 142 are formed of a transparent, semitransparent, translucent, clear, colored, or semi-opaque material, such as toughened glass, sappire glass. Alternate materials of construction of the first window element 141 and the second window element 142 may include one or more of the following: toughened or tempered glass, safety glass, an acrylic, Poly(methyl methacrylate) (PMMA), a Polycarbonate (PC), a thermoplastic polymer, glass-hardened polymers, polymeric composites, high-strength plastics, nylon, glass, or polymer fiber reinforced plastics, thermoform and/or thermoset materials, transparent or semitransparent aluminum, and/or various combinations of the foregoing. Thus, it should be understood that the material or materials used to form the first window element 141 and the second window element 142 is a design choice based on the desired degree of opacity, appearance, and/or functionality of the first window element 141 and the second window element 142.

In various exemplary, nonlimiting embodiments, the first window element 141 (or a discreet portion thereof) and/or the second window element 142 (or a discreet portion thereof) may optionally be formed of a magnifying glass or glass shaped so as to magnify an image. In these optional embodiments, the magnifying glass can aid in visual inspection of the firearm's chamber, when the windowed ejection port cover 100 is in a closed position.

In certain exemplary embodiments, one or both of the first window element 141 or the second window element 142 may optionally include or be formed of an illuminating or illumination material. Alternatively, one or more light emitting diodes (LED) or other illumination elements 147 may be included in or as part of the first window element 141 or the second window element 142. The one or more illumination elements 147, provides illumination of at least a portion of the interior of a firearm, when the windowed ejection port cover 100 is in a closed position. It may also help to provide in identifying or locating light when the windowed ejection port cover 100 is in an open or closed position.

It should be appreciated that if the illumination element(s) 147 are included, and appropriate power source and any necessary circuitry in order to power or adjust the illumination element(s) 147 is also included on or within the elements of the windowed ejection port cover 100. Additionally, one or more switches or sensors may be included so as to allow the illumination element(s) 147 to be illuminated (turned on) or is extinguished (turned off) as desired by the user or when the windowed ejection port cover 100 is in a desired position i.e., in an open or closed position.

As further illustrated in FIGS. 5-11, a first window coupling element 151 and a second window coupling element 152 are utilized to secure the first window element 141 and the second window element 142 into the first window aperture 131 and second window aperture 132, respectively. It should be understood that the number and shape of each window coupling element is such that it allows the respective window elements to be permanently or removably coupled within the window apertures.

Figure 10:
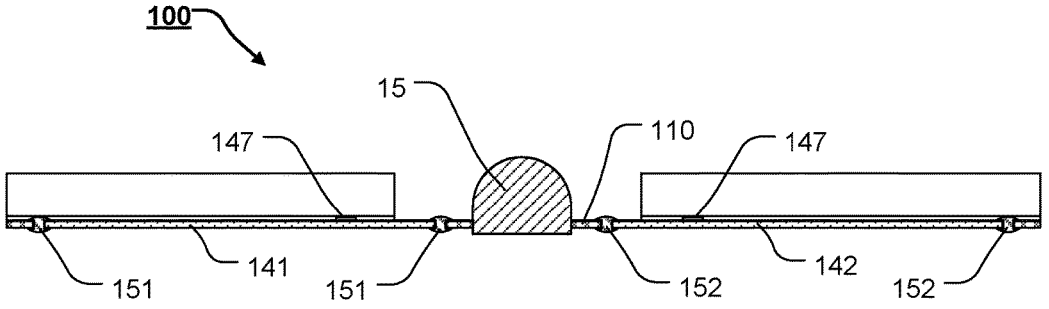
FIG. 10 illustrates a top, cross-sectional view taken along line 10-10 of the windowed ejection port cover of FIG. 8, according to the presently disclosed systems, methods, and/or apparatuses.

In certain exemplary embodiments, as illustrated most clearly in FIG. 10, the first window coupling element 151 and the second window coupling element 152 comprise substantially "H" shaped portions of material that simultaneously allow a portion of the body 110 to be received within one side of the "H" shaped portion of material and allow a portion of the respective window element 141 or 142 to be received within the other side of the "H" shaped portion of material.

The first window coupling element 151 and the second window coupling element 152 may optionally be formed of a somewhat flexible or malleable material, such as, for example, a rubber gasket material. Alternatively, the window coupling elements 151 and 152 may be formed of a substantially rigid material. Thus, a substantially flexible or malleable material may be used to form the window coupling elements 151 and 152 so as to allow the window elements 141 and 142 to be removed and replaced within the body 110 of the windowed ejection port cover 100. Alternatively, a more rigid or non-flexible material may be used to form the window coupling elements 151 and 152 so as to keep the window elements 141 and 142 from being easily removed from within the body 110.

Figure 11:
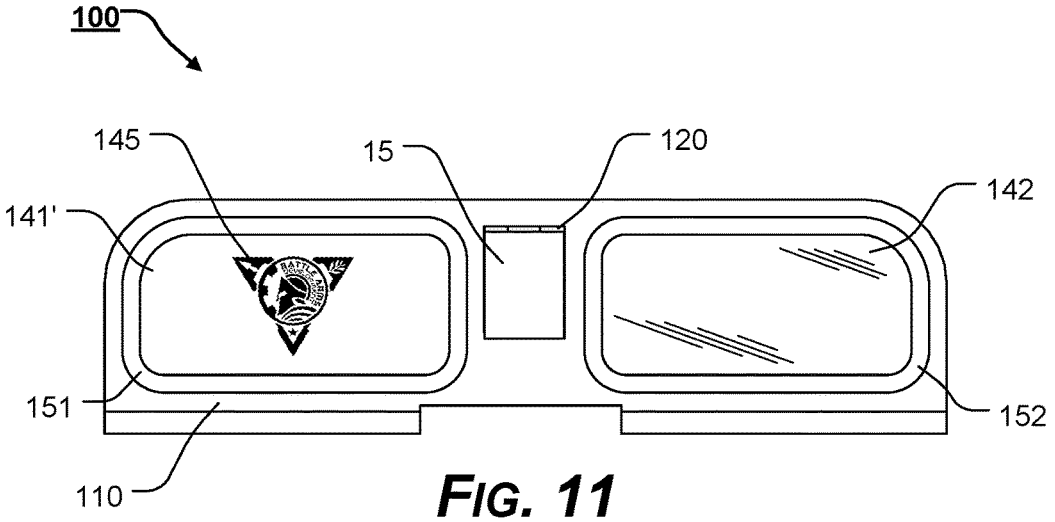
FIG. 11 illustrates a right side view of an exemplary embodiment of a windowed ejection port cover, having an attached or coupled plunger assembly, according to the presently disclosed systems, methods, and/or apparatuses.
Figure 12:
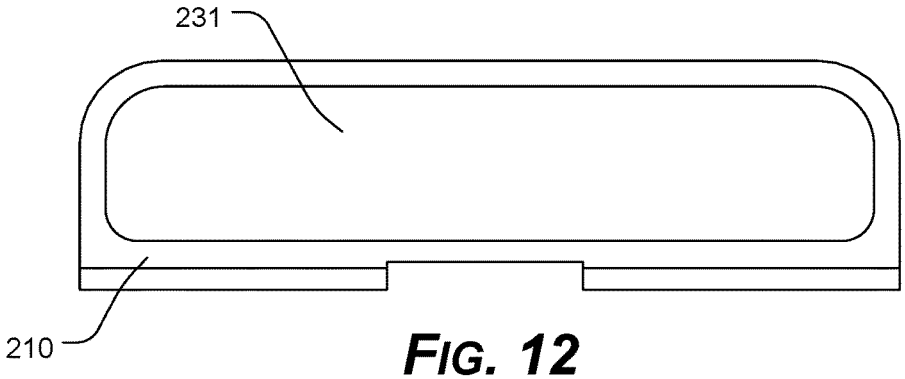
FIG. 12 illustrates a right side view of an exemplary embodiment of an ejection port cover body, according to the presently disclosed systems, methods, and/or apparatuses.
Figure 13:
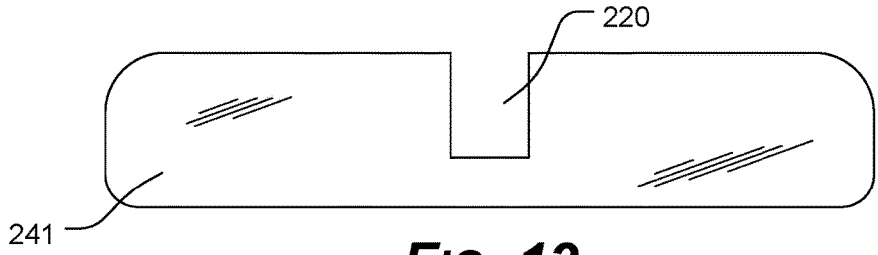
FIG. 13 illustrates a right side view of an exemplary embodiment of a windowed ejection port cover window, according to the presently disclosed systems, methods, and/or apparatuses.
Figure 14:
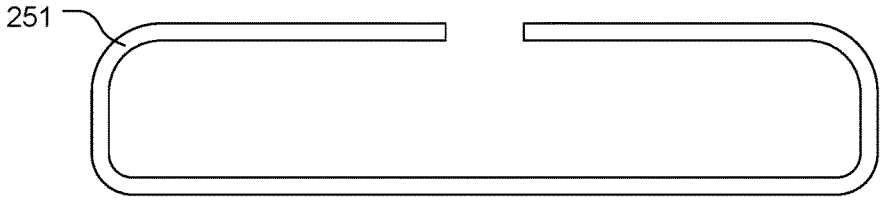
FIG. 14 illustrates a right side view of an exemplary embodiment of a windowed ejection port cover gasket, according to the presently disclosed systems, methods, and/or apparatuses.
Figure 15:
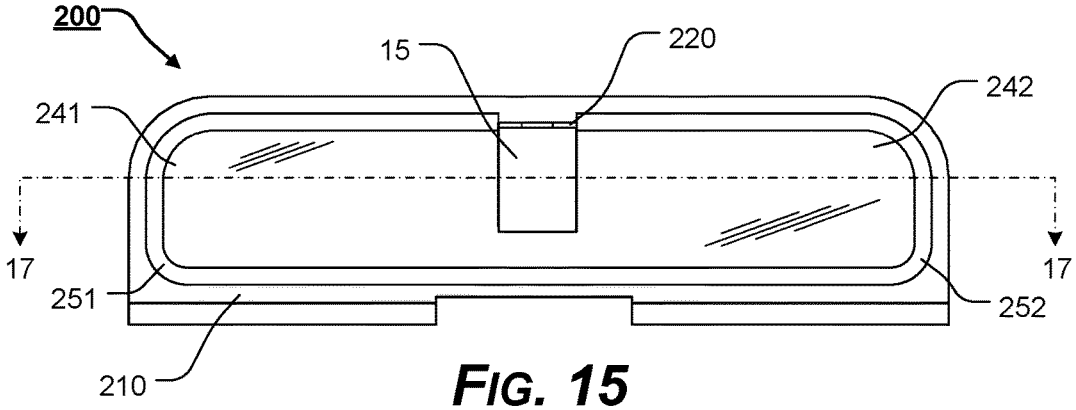
FIG. 15 illustrates a right side view of an exemplary embodiment of a windowed ejection port cover, having an attached or coupled plunger assembly, according to the presently disclosed systems, methods, and/or apparatuses.
Figure 16:
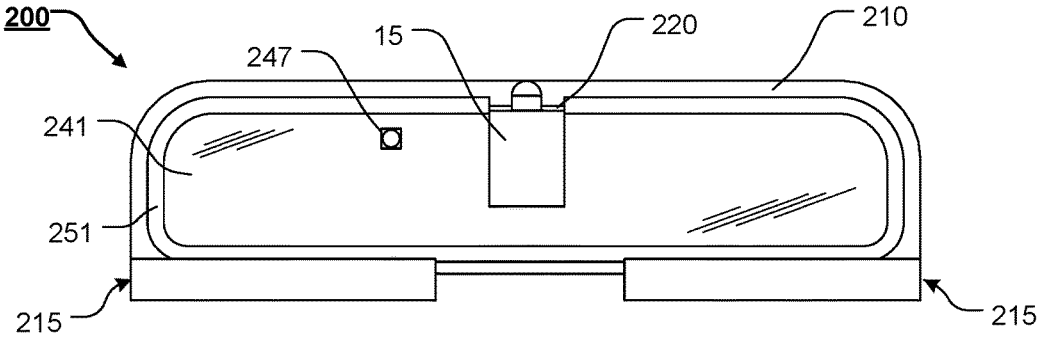
FIG. 16 illustrates a left side view of an exemplary embodiment of a windowed ejection port cover, having an attached or coupled plunger assembly, according to the presently disclosed systems, methods, and/or apparatuses.

FIG. 11 illustrates a windowed ejection port cover 100, having an attached or coupled plunger assembly 15, wherein the first window element 141 has been replaced with a first window element 141'. As illustrated, the first window element 141' may optionally comprise a window element that is less transparent or more opaque than the second window element 142. Additionally, the first window element 141' includes indicia 145 applied thereto or embedded therein. In certain exemplary embodiments, the indicia 145 may represent a trademark or other word, phrase, or element, thereby providing additional originality to the windowed ejection port cover 100.

FIGS. 12-18 illustrate certain elements and/or aspects of an exemplary embodiment of the windowed ejection port cover 200, according to the presently disclosed systems, methods, and/or apparatuses. In an illustrative, non-limiting embodiment of the present disclosure, as illustrated in FIGS. 12-18, the windowed ejection port cover 200 comprises at least some of an apertured ejection port cover body 210 having a pivot aperture 215.

In various exemplary, nonlimiting embodiments, the apertured ejection port cover body 210 has an overall size and shape that allows it to interact with a desired firearm, such as, for example, an upper receiver 5. As illustrated, the pivot aperture 215 is formed of two curved extension portions of the body 210. It should be appreciated that the pivot aperture 215 is formed so as to interact with a known ejection port cover hinge pin 28, so as to be pivotably attached to, for example, an upper receiver 5, via interaction of an ejection port cover hinge pin 28 and the pivot aperture 215.

In various exemplary embodiments, the body 210 is substantially rigid and is formed of sheet metal, such as steel. Alternate materials of construction of the body 210 may include one or more of the following: aluminum, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the body 210 is a design choice based on the desired appearance and/or functionality of the body 210.

As illustrated in FIGS. 12-18, a single window aperture 231 is formed through the body 210. As illustrated, the window aperture 231 has a substantially rectangular overall shape. However, it should be appreciated that the overall size, shape, and appearance of the window aperture 231 is a design choice, based upon the desired size and location of resulting transparent, semitransparent, translucent, clear, colored, or semi-opaque portions of the apertured ejection port cover 210. Thus, it should be understood that the window aperture 231 formed through the body 210 may have an overall round, oval, triangular, square, rectangular, or other defined or unique shape.

In various exemplary, nonlimiting embodiments, a window element, such as, for example, the window element 241 is included. The window element 241 is formed such that the window element 241 may be at least partially received within the window aperture 231. The window element 241 is formed of a material that provides a see-through or at least partially see-through window in the aperture ejection port cover 200.

For example, in various exemplary, nonlimiting embodiments, the window element 241 is formed of a transparent, semitransparent, translucent, clear, colored, or semi-opaque material, such as toughened glass, sappire glass. Alternate materials of construction of the window element 241 may include one or more of the following: toughened or tempered glass, safety glass, an acrylic, Poly(methyl methacrylate) (PMMA), a Polycarbonate (PC), a thermoplastic polymer, glass-hardened polymers, polymeric composites, high-strength plastics, nylon, glass, or polymer fiber reinforced plastics, thermoform and/or thermoset materials, and/or various combinations of the foregoing. Thus, it should be understood that the material or materials used to form the window element 241 is a design choice based on the desired degree of opacity, appearance, and/or functionality of the window element 241.

In various exemplary, nonlimiting embodiments, the window element 241 (or a discreet portion thereof) may optionally be formed of a magnifying glass or glass shaped so as to magnify an image. In these optional embodiments, the magnifying glass can aid in visual inspection of the firearm's chamber, when the windowed ejection port cover 200 is in a closed position.

In certain exemplary embodiments, the window element 241 may optionally include or be formed of an illuminating or illumination material. Alternatively, one or more light emitting diodes (LED) or other illumination elements 247 may be included in or as part of the window element 241. The one or more illumination elements 247, provides illumination of at least a portion of the interior of a firearm, when the windowed ejection port cover 200 is in a closed position. It may also help to provide in identifying or locating light when the windowed ejection port cover 200 is in an open or closed position.

It should be appreciated that if the illumination element(s) 247 are included, and appropriate power source and any necessary circuitry in order to power or adjust the illumination element(s) 247 is also included on or within the elements of the windowed ejection port cover 200. Additionally, one or more switches or sensors may be included so as to allow the illumination element(s) 147 to be illuminated (i.e., turned on) or is extinguished (i.e., turned off) as desired by the user or when the windowed ejection port cover 200 is in a desired position i.e., in an open or closed position.

A plunger assembly aperture or recess 220 is formed so as to allow a plunger assembly 15 to interact with the plunger assembly aperture or recess 220, so as to be attached or coupled to the windowed ejection port cover 200. It should be appreciated that the pivot aperture 215 and the plunger assembly 15 allow the windowed ejection port cover 200 to be pivotably attached to a firearm and pivot between an open position and a closed position, in a manner similar to a known ejection port cover 10.

As further illustrated in FIGS. 12-18, a window coupling element 251 is utilized to secure the window element 241 into the window aperture 231. It should be understood that the shape of window coupling element 251 is such that the window coupling element 251 allows the window element 241 to be permanently or removably coupled within the window aperture 231.

Figure 17:
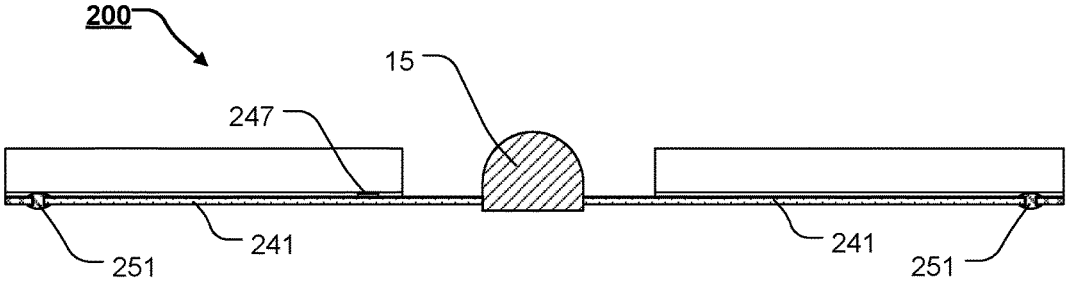
FIG. 17 illustrates a top, cross-sectional view taken along line 17-17 of the windowed ejection port cover of FIG. 15, according to the presently disclosed systems, methods, and/or apparatuses.

In certain exemplary embodiments, as illustrated most clearly in FIG. 17, the window coupling element 251 comprises a substantially "H" shaped portion of material that simultaneously allow a portion of the body 210 to be received within one side of the "H" shaped portion of material and allow a portion of the window element 241 to be received within the other side of the "H" shaped portion of material.

The window coupling element 251 may optionally be formed of a somewhat flexible or malleable material, such as, for example, a rubber gasket material. Alternatively, the window coupling elements 251 may be formed of a substantially rigid material. Thus, a substantially flexible or malleable material may be used to form the window coupling element 251 so as to allow the window element 241 to be removed and replaced within the body 210 of the windowed ejection port cover 200. Alternatively, a more rigid or non-flexible material may be used to form the window coupling element 251 so as to keep the window element 241 from being easily removed from within the body 210.

Figure 18:
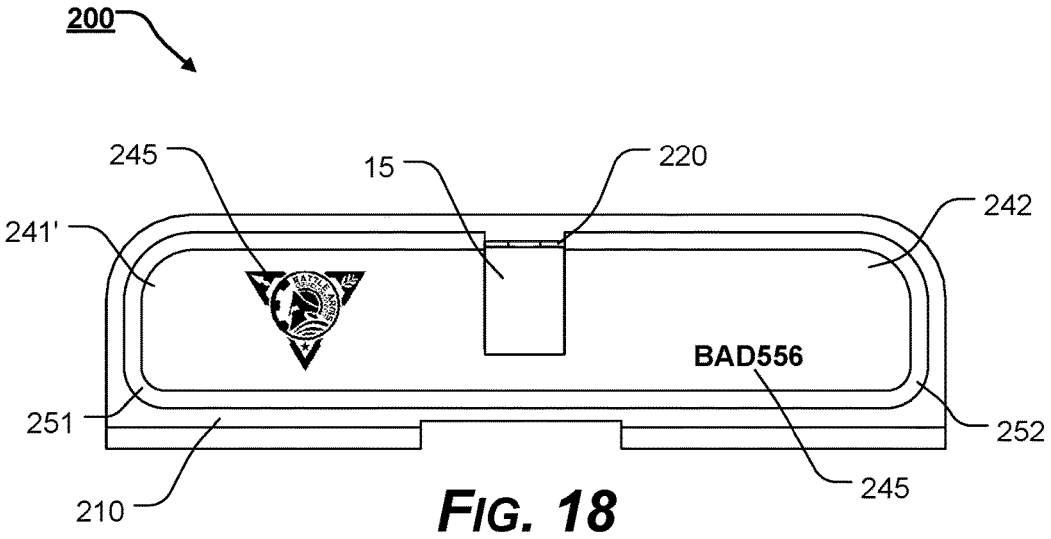
FIG. 18 illustrates a right side view of an exemplary embodiment of a windowed ejection port cover, having an attached or coupled plunger assembly, according to the presently disclosed systems, methods, and/or apparatuses.
Figure 19:
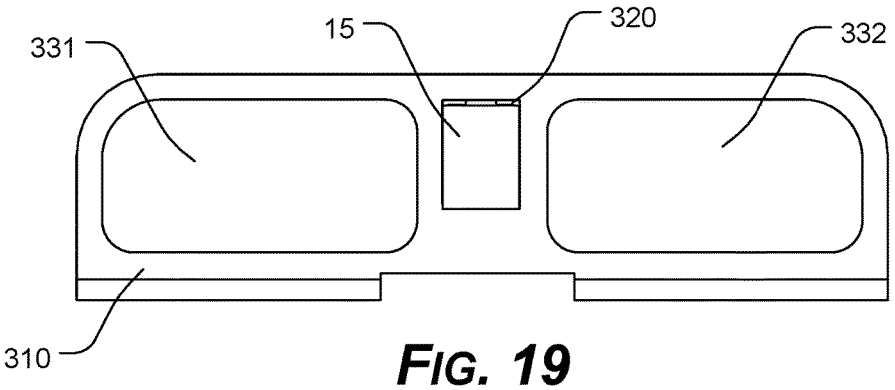
FIG. 19 illustrates a right side view of an exemplary embodiment of an ejection port cover body, having an attached or coupled plunger assembly, according to the presently disclosed systems, methods, and/or apparatuses.
Figure 20:
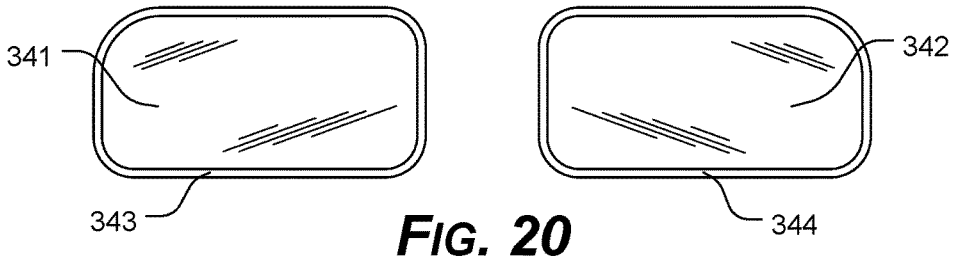
FIG. 20 illustrates a right side view of certain exemplary embodiments of windowed ejection port cover windows, according to the presently disclosed systems, methods, and/or apparatuses.
Figure 21:
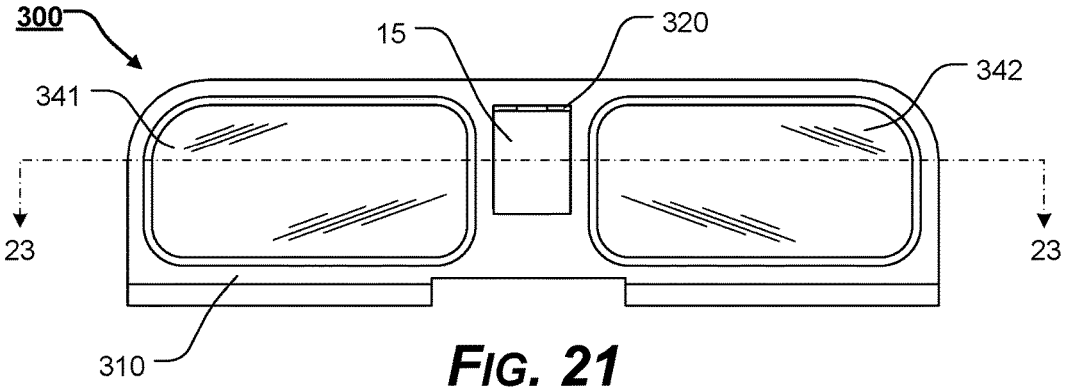
FIG. 21 illustrates a right side view of an exemplary embodiment of a windowed ejection port cover, having an attached or coupled plunger assembly, according to the presently disclosed systems, methods, and/or apparatuses.
Figure 22:
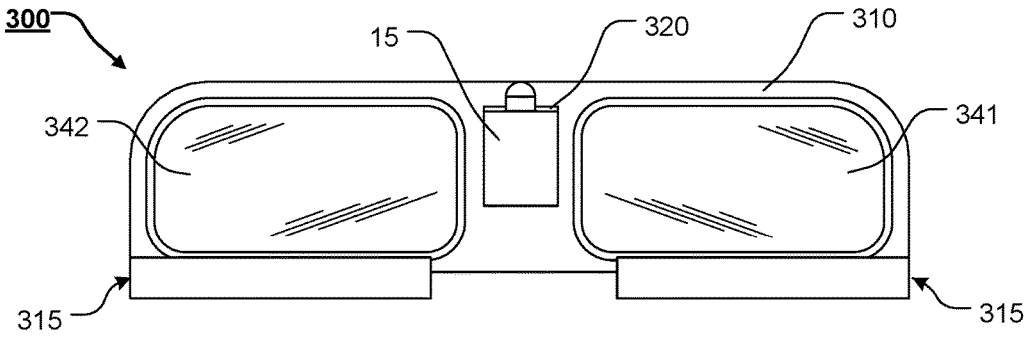
FIG. 22 illustrates a left side view of an exemplary embodiment of a windowed ejection port cover, having an attached or coupled plunger assembly, according to the presently disclosed systems, methods, and/or apparatuses.
Figure 23:
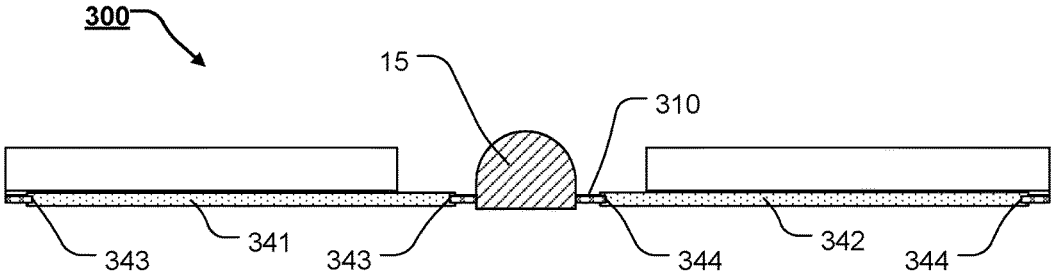
FIG. 23 illustrates a top, cross-sectional view taken along line 23-23 of the windowed ejection port cover of FIG. 21, according to the presently disclosed systems, methods, and/or apparatuses.

FIG. 18 illustrates a windowed ejection port cover 200, having an attached or coupled plunger assembly 15, wherein the window element 241 has been replaced with a window element 241'. As illustrated, the window element 241' may optionally be less transparent or more opaque than the window element 241. Additionally, the window element 241' includes a plurality of indicia 245 applied thereto or embedded therein. In certain exemplary embodiments, the indicia 245 may represent a trademark or other word, phrase, or element, thereby providing additional originality to the windowed ejection port cover 200.

FIGS. 19-23, illustrate certain elements and/or aspects of an exemplary embodiment of the windowed ejection port cover 300, according to the presently disclosed systems, methods, and/or apparatuses. As illustrated in FIGS. 19-23, the windowed ejection port cover 300 comprises at least some of an ejection port cover body 310, a pivot aperture 315, a plunger assembly aperture 320, an attached or coupled plunger assembly 15, a first window aperture 331, and a second window aperture 332.

It should be understood that each of these elements corresponds to and operates similarly to the ejection port cover body 110, the pivot aperture 115, the plunger assembly aperture 120, the attached or coupled plunger assembly 15, the first window aperture 331, and the second window aperture 332, as described above with reference to the windowed ejection port cover 100 of FIGS. 5-11.

However, as illustrated in FIGS. 19-23, the first window element 141 and the second window element 142 of the windowed ejection port cover 100 are replaced by a first window element 341 and a second window element 342. It should be understood that the first window element 341 and the second window element 342 may be constructed of a material and have the same or similar characteristics to those of the first window element 141 and the second window element 142. However, the first window element 341 and the second window element 342 each include a channel 343 and 344, respectively. In certain exemplary embodiments, as illustrated most clearly in FIG. 23, the channel 343 and the channel 344 comprise substantially "U" shaped groove or recess formed within an edge portion of the first window element 341 and the second window element 342, respectively.

The channel 343 allows a portion of the body 310 to be received within the channel 343, allowing a portion of the first window element 341 to be attached, or snap fitted, within the first window aperture 331, while the channel 344 allows a portion of the body 310 to be received within the channel 343, allowing a portion of the second window element 342 to be attached, or snap fitted, within the second window aperture 332.

Figure 24:
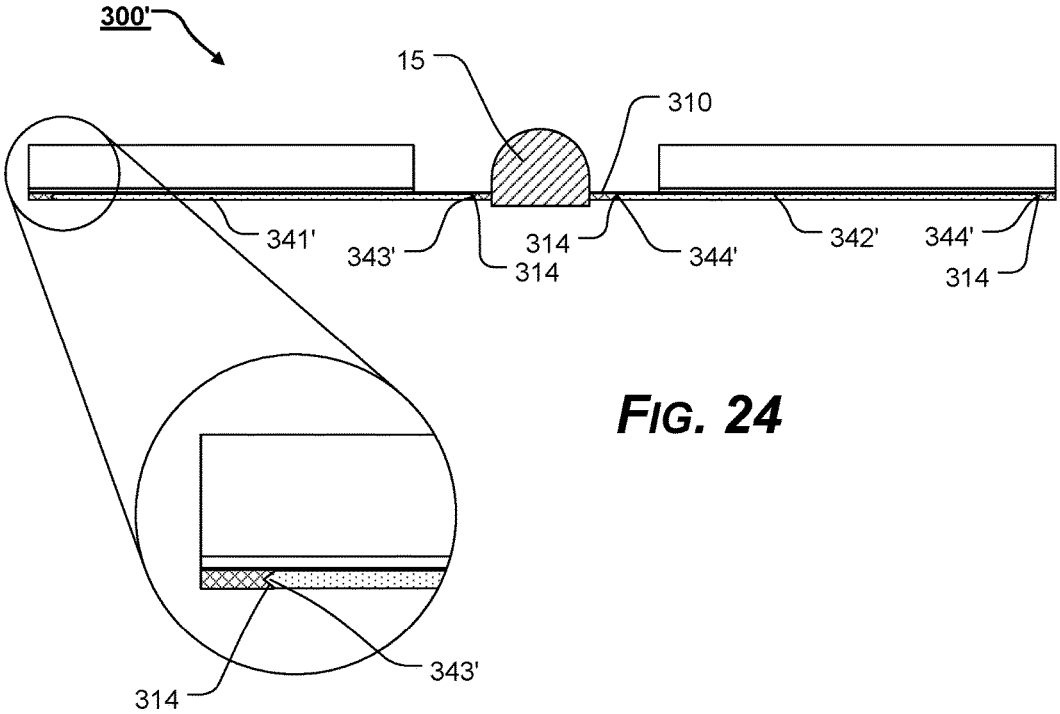
FIG. 24 illustrates a top, cross-sectional view of a first exemplary embodiment of a windowed ejection port cover, having an attached or coupled plunger assembly, according to the presently disclosed systems, methods, and/or apparatuses.

FIG. 24 illustrates a top, cross-sectional view of an exemplary embodiment of a windowed ejection port cover 300'. As illustrated, the window elements 341' and 342' include one or more "U" or "V" shaped protrusions 343' and 344', which extend around at least an edge or perimeter portion of the window elements 341' and 342'. Correspondingly shaped "U" or "V" shaped receiving channels 314 are formed in at least a portion of the first window aperture 331 and the second window aperture 332.

The channel 314 formed in the first window aperture 331 allows at least a portion of the protrusion 343' to be received within the channel 314, allowing a portion of the first window element 341' to be attached, or snap fitted, within the first window aperture 331. Likewise, the channel 314 formed in the second window aperture 332 allows at least a portion of the protrusion 344' to be received within the channel 314, allowing a portion of the second window element 342' to be attached, or snap fitted, within the second window aperture 332.

Figure 25:
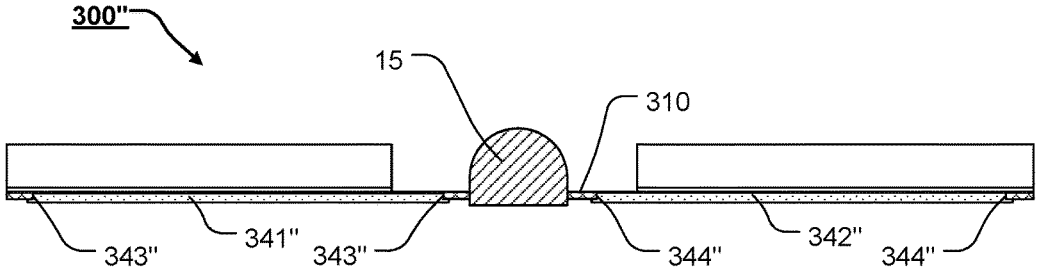
FIG. 25 illustrates a top, cross-sectional view of an exemplary embodiment of a windowed ejection port cover, having an attached or coupled plunger assembly, according to the presently disclosed systems, methods, and/or apparatuses.
Figure 26:
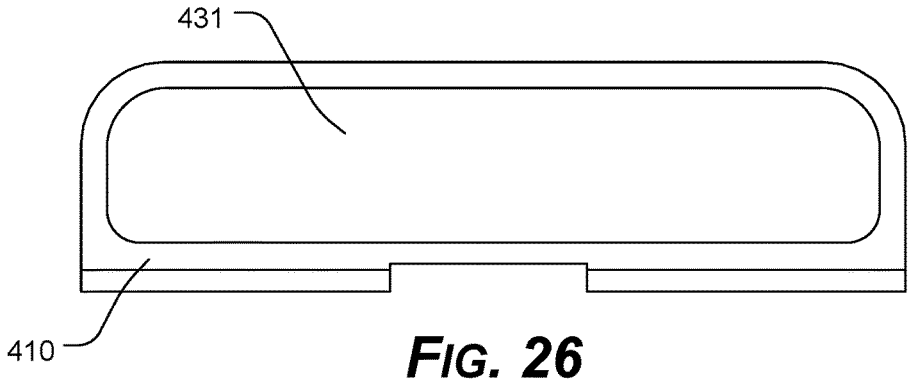
FIG. 26 illustrates a right side view of an exemplary embodiment of an ejection port cover body, according to the presently disclosed systems, methods, and/or apparatuses.
Figure 27:
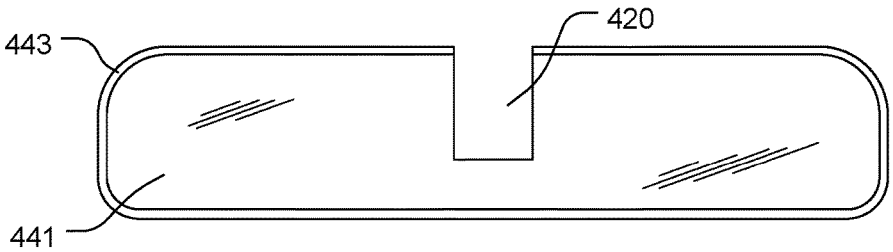
FIG. 27 illustrates a right side view of an exemplary embodiment of a windowed ejection port cover window, according to the presently disclosed systems, methods, and/or apparatuses.
Figure 28:
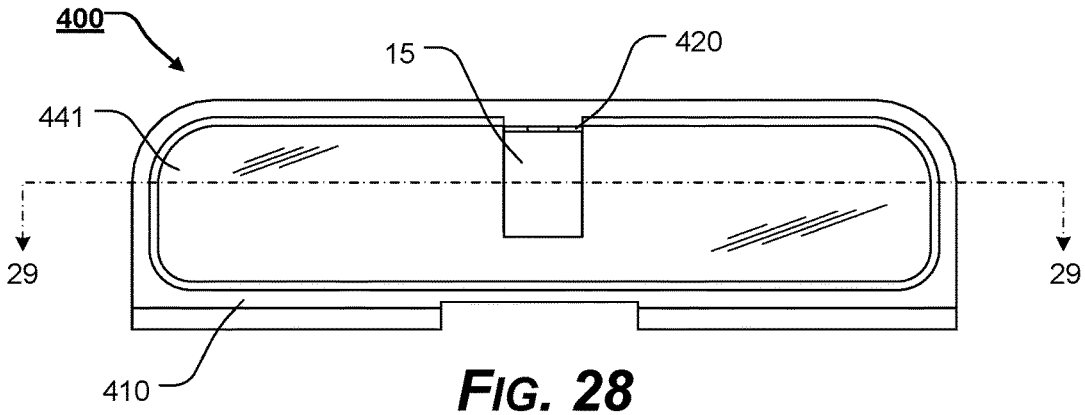
FIG. 28 illustrates a right side view of an exemplary embodiment of a windowed ejection port cover, having an attached or coupled plunger assembly, according to the presently disclosed systems, methods, and/or apparatuses.
Figure 29:
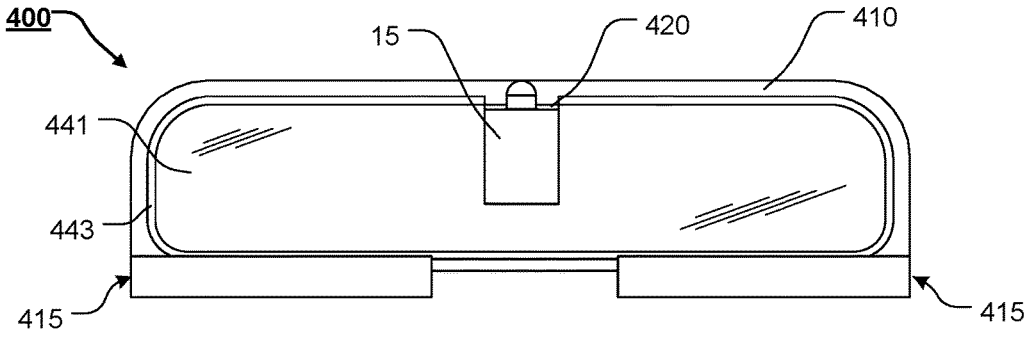
FIG. 29 illustrates a left side view of an exemplary embodiment of a windowed ejection port cover, having an attached or coupled plunger assembly, according to the presently disclosed systems, methods, and/or apparatuses.
Figure 30:
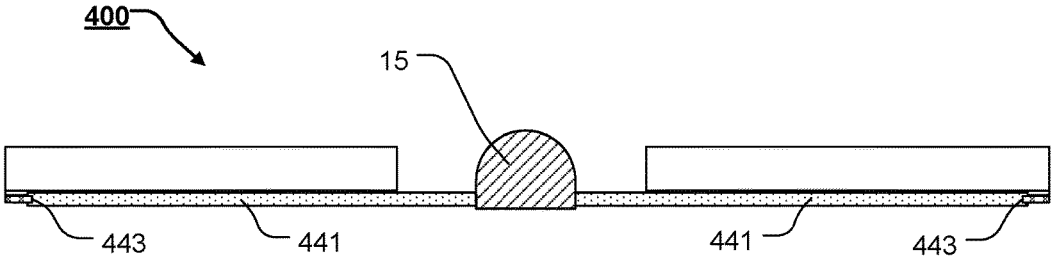
FIG. 30 illustrates a top, cross-sectional view taken along line 29-29 of the windowed ejection port cover of FIG. 27, according to the presently disclosed systems, methods, and/or apparatuses.

FIG. 25 illustrates a top, cross-sectional view of another exemplary embodiment of a windowed ejection port cover 300". As illustrated, the window elements 341" and 342" include one or more protrusions 343" and 344", which extend around at least an edge or perimeter portion of the window elements 341" and 342". The one or more protrusions 343" and 344" are shaped so as to extend beyond at least a portion of the first window aperture 331 and the second window aperture 332. Thus, when the window elements 341" and 342" are appropriately positioned within the first window aperture 331 and the second window aperture 332, respectively, the one or more protrusions 343" and 344" extend beyond at least a portion of the first window aperture 331 and the second window aperture 332.

In certain exemplary embodiments, an adhesive, sonic weld, or other physical, mechanical, or chemical bond may be applied between at least a portion of the one or more protrusions 343" and 344" and the first and second window apertures 331 and 332, thereby further securing the window elements 341" and 342" within the first and second window apertures 331 and 332.

FIGS. 26-30, illustrate certain elements and/or aspects of an exemplary embodiment of the windowed ejection port cover 400, according to the presently disclosed systems, methods, and/or apparatuses. As illustrated in FIGS. 26-30, the windowed ejection port cover 400 comprises at least some of an ejection port cover body 410, a pivot aperture 415, a plunger assembly aperture 420, an attached or coupled plunger assembly 15, and a window aperture 431.

It should be understood that each of these elements corresponds to and operates similarly to the ejection port cover body 210, the pivot aperture 215, the plunger assembly aperture 220, the attached or coupled plunger assembly 15, and the window aperture 431, as described above with reference to the windowed ejection port cover 200 of FIGS. 12-18.

However, as illustrated in FIGS. 26-30, the window element 241 (or the window element 241') of the windowed ejection port cover 200 is replaced by a window element 441'. It should be understood that the window element 441' may be constructed of a material and have the same or similar characteristics to those of the window element 241. However, the window element 441' includes a channel 443. In certain exemplary embodiments, as illustrated most clearly in FIG. 30, the channel 443 comprise a substantially "U" shaped groove or recess formed within an edge portion of the window aperture 431.

The channel 443 allows a portion of the body 410 to be received within the channel 443, allowing a portion of the window element 441 to be attached, or snap fitted, within the window aperture 431.

Figure 31:
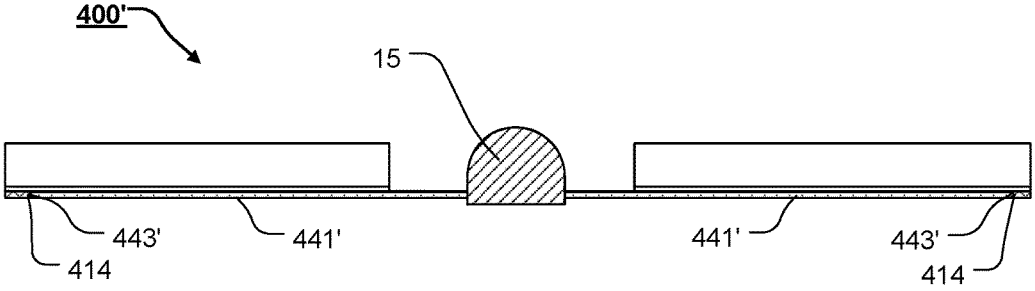
FIG. 31 illustrates a top, cross-sectional view of a first exemplary embodiment of a windowed ejection port cover, having an attached or coupled plunger assembly, according to the presently disclosed systems, methods, and/or apparatuses.

FIG. 31 illustrates a top, cross-sectional view of an exemplary embodiment of a windowed ejection port cover 400'. As illustrated, the window element 441' includes one or more "U" or "V" shaped protrusions 443', which extend around at least an edge or perimeter portion of the window element 441'. Correspondingly shaped "U" or "V" shaped receiving channels 414 are formed in at least a portion of the window aperture 431.

The channel 414 formed in the window aperture 431 allows at least a portion of the protrusion 443' to be received within the channel 414, allowing a portion of the window element 441" to be attached, or snap fitted, within the window aperture 431.

Figure 32:
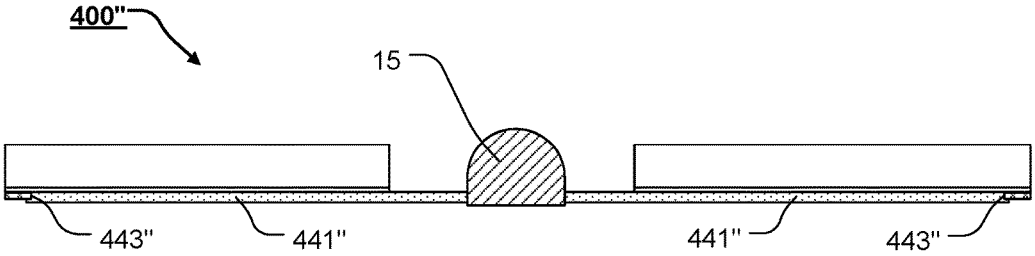
FIG. 32 illustrates a top, cross-sectional view of an exemplary embodiment of a windowed ejection port cover, having an attached or coupled plunger assembly, according to the presently disclosed systems, methods, and/or apparatuses.

FIG. 32 illustrates a top, cross-sectional view of another exemplary embodiment of a windowed ejection port cover 400". As illustrated, the window element 441" includes one or more protrusions 443", which extend around at least an edge or perimeter portion of the window element 441". The one or more protrusions 443" are shaped so as to extend beyond at least a portion of the window aperture 431. Thus, when the window element 441" is appropriately positioned within the window aperture 431, the one or more protrusions 443" extend beyond at least a portion of the window aperture 431.

In certain exemplary embodiments, an adhesive, sonic weld, or other physical, mechanical, or chemical bond may be applied between at least a portion of the one or more protrusions 443" and the first window aperture 431, thereby further securing the window element 441" within the first window aperture 431.

Figure 33:
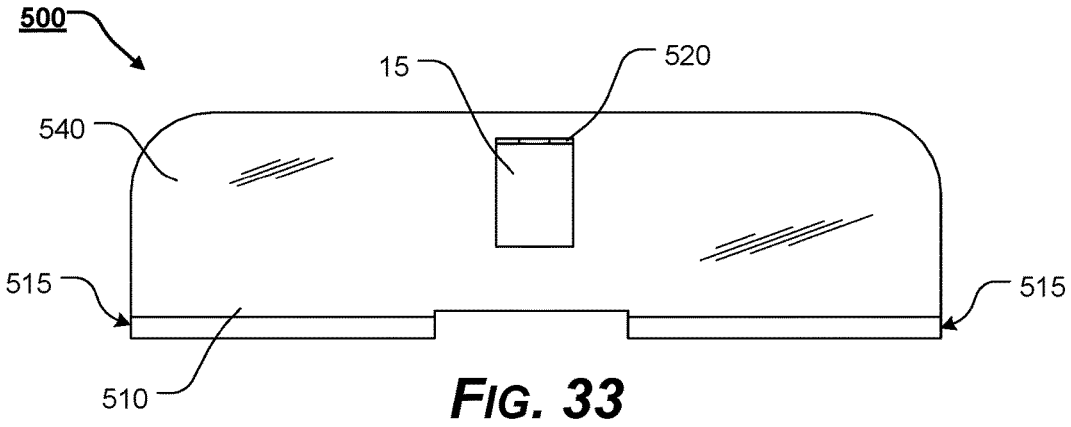
FIG. 33 illustrates a right side view of an exemplary embodiment of a windowed ejection port cover, having an attached or coupled plunger assembly, according to the presently disclosed systems, methods, and/or apparatuses.
Figure 34:
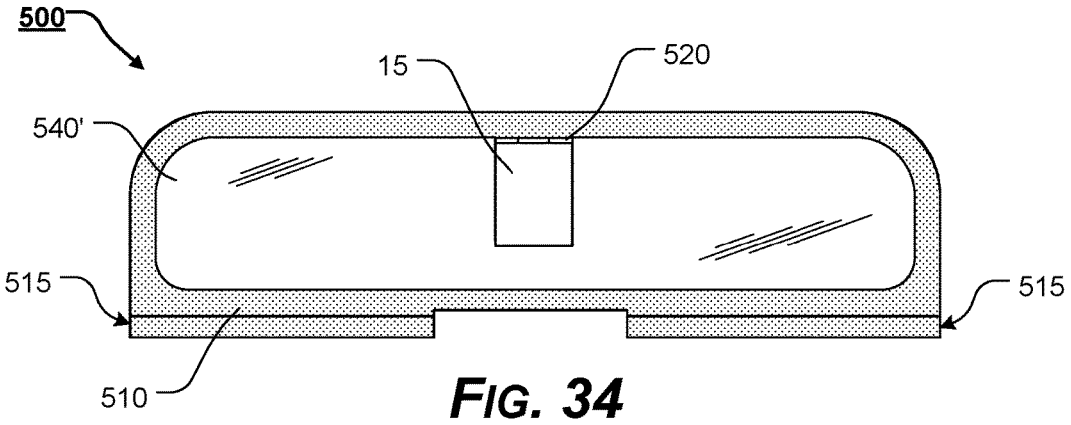
FIG. 34 illustrates a right side view of an exemplary embodiment of a windowed ejection port cover, having an attached or coupled plunger assembly, according to the presently disclosed systems, methods, and/or apparatuses.
Figure 35:
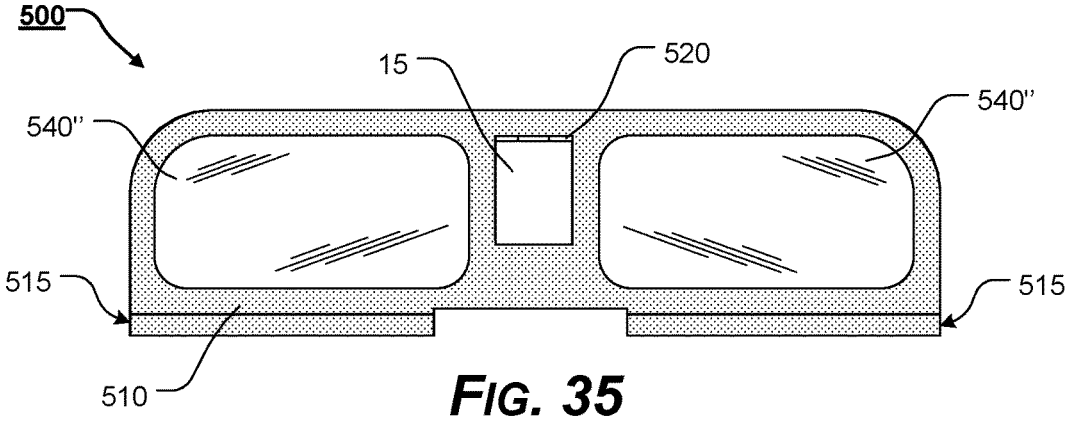
FIG. 35 illustrates a right side view of an exemplary embodiment of a windowed ejection port cover, having an attached or coupled plunger assembly, according to the presently disclosed systems, methods, and/or apparatuses.

FIGS. 33-35, illustrate certain elements and/or aspects of exemplary embodiments of the windowed ejection port cover 500, according to the presently disclosed systems, methods, and/or apparatuses. As illustrated in FIGS. 33-35, the windowed ejection port cover 500 comprises at least some of an ejection port cover body portion 510, a pivot aperture 515, a plunger assembly aperture 520, an attached or coupled plunger assembly 15, and a single window portion 540 or 540' or two or more window portions 540".

It should be understood that the pivot aperture 515, the plunger assembly aperture 520, and the plunger assembly 15 correspond to and operates similarly to the correspondingly named elements described herein. Furthermore, it should be appreciated that the overall function of the windowed ejection port cover 500 is substantially similar to that of the windowed ejection port cover described herein.

However, the windowed ejection port cover 500 is formed of an ejection port cover body portion 510 and a single window portion 540 or 540' or two or more window portions 540".

In various exemplary, nonlimiting embodiments, the entire windowed ejection port cover 500 may be formed of the same material, such that the entire, single window portion 540 may have the same degree or level of opacity, clarity, transparency, translucency, or other optical appearance or property. Thus, the entire single window portion 540 may, for example, be transparent.

In certain exemplary, nonlimiting embodiments, various areas or portions of the windowed ejection port cover 500 can be provided with various similar or different levels of opacity, clarity, transparency, translucency, or other optical appearance or property, to form the ejection port cover body portion 510 and the one or more window portions 540' or 540".

In certain exemplary embodiments, the ejection port cover body portion 510 and the window portion(s) 540, 540', and 540" are formed as a single, unitary portion of material, such as, for example, a single, injection molded portion of a polymer. Alternatively, the various portions of the ejection port cover 500 may be formed of separate components that are attached, coupled, welded, glued, or otherwise bonded together to form the ejection port cover 500. For example, a portion of the ejection port cover 500 forming or containing the pivot aperture 515 may be separately formed and joined a second portion of material to form the ejection port cover 500.

In certain exemplary embodiments, various surface preparations, frosting, pigmentation, coloring, tinting, painting, laminating, coatings, or other known or future developed methods or processes, provide various portions of the ejection port cover body portion 510 with a different level of transparency or opacity to form the one or more window portions 540, 540', or 540".

For example, as illustrated in FIG. 33, the entire ejection port cover body portion 510 may be partially or fully opaque, such that the entire ejection port cover body portion 510 forms a single window portion 540.

In other exemplary embodiments, as illustrated in FIG. 34, a portion of the ejection port cover body portion 510 is partially or fully opaque, while a single window portion 540' is clear, transparent, or translucent or substantially clear, transparent, or translucent.

In still other exemplary embodiments, as illustrated in FIG. 35, a portion of the ejection port cover body portion 510 may be partially or fully opaque, while two or more window portions 540" may defined by the ejection port cover body portion 510 and may be clear, transparent, or translucent or substantially clear, transparent, or translucent.

In one exemplary, nonlimiting embodiment, the windowed ejection port cover 500 may initially be provided as a single unit formed of a transparent material. In various areas of the windowed ejection port cover 500, representing the one or more window portions 540' or 540", may then be masked off. A surface preparation, such as, for example, painting or bead blasting may be applied to the windowed ejection port cover 500. Then, when the masking material is removed, the one or more window portions 540' or 540" are revealed.

It should be appreciated that the size, shape, and area occupied by the ejection port cover body portion 510 and the one or more window portions 540, 540', or 540" is a design choice based upon the desired appearance and/or functionality of the windowed ejection port cover 500.

It should also be understood that the material used to form at least the one or more window portions 540 or 540' may have certain inherent optical properties or may be formed (i.e., have a concave or convex outer and/or inner surface), so as to provide a user with a magnified view of at least a portion of the interior of a firearm, when the windowed ejection port cover 500 is in a closed position.

In certain other exemplary embodiments, the ejection port cover body portion 510 may be formed of one or more portions of material having one or more apertures sized and shaped so as to receive one or more corresponding window portions 540' or 540".

In these exemplary embodiments, the ejection port cover body portion 510 may be formed of a material having a determined level of opacity, clarity, transparency, translucency, or other optical appearance or property while the one or more corresponding window portions 540' or 540" may be formed of a material having a determined level of opacity, clarity, transparency, translucency, or other optical appearance or property that is different from that of the ejection port cover body portion 510. The window portions 540' or 540" may then be positioned within the corresponding apertures formed in the ejection port cover body portion 510 and frictionally attached, coupled, welded, glued, or otherwise bonded to the ejection port cover body portion 510 to form the ejection port cover 500.

It should be appreciated that a more detailed explanation of the standard features and elements of a receiver, such as upper receiver 5, which are not related to the present disclosure, instructions regarding how to attach the windowed ejection port cover to an upper receiver, and certain other items and/or techniques necessary for the implementation and/or operation of the various exemplary embodiments of the present disclosure are not provided herein because such elements are commercially available and/or such background information will be known to one of ordinary skill in the art. Therefore, it is believed that the level of description provided herein is sufficient to enable one of ordinary skill in the art to understand and practice the present disclosure, as described.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An ejection port cover configured to be attached or coupled to a receiver of a replica or non-replica firearm, comprising:

An ejection port cover body, wherein said ejection port cover body is substantially clear, transparent, or translucent, and wherein a plunger assembly aperture or recess is formed in at least a portion of said ejection port cover body, said plunger assembly aperture or recess formed so as to allow a plunger assembly to be attached or coupled to said ejection port cover body;

wherein at least a portion of said plunger assembly is configured to be received at least partially within an ejection port when said ejection port cover is in a closed position.

2. The ejection port cover of claim 1, further comprising:

at least one ejection port cover body portion, wherein a level of opacity, clarity, transparency, translucency, or optical appearance or property of said at least one ejection port cover body portion is different from a level of opacity, clarity, transparency, translucency, or optical appearance or property of said ejection port cover body.

* * * * *